United States Patent [19]

Ecker

[11] Patent Number: 4,615,690

[45] Date of Patent: Oct. 7, 1986

[54] CENTRIFUGE

[75] Inventor: Peter Ecker, Haarbach, Fed. Rep. of Germany

[73] Assignee: Flottweg-Werk BMCo. GmbH, Vilsbiburg, Fed. Rep. of Germany

[21] Appl. No.: 678,452

[22] Filed: Dec. 5, 1984

[30] Foreign Application Priority Data

Dec. 8, 1983 [DE] Fed. Rep. of Germany ..... 3344432

[51] Int. Cl.[4] ..... B04B 11/02

[52] U.S. Cl. ..... 494/56; 494/57

[58] Field of Search ..... 494/56, 57

[56] References Cited

U.S. PATENT DOCUMENTS

| | | | |
|---|---|---|---|
| 1,225,416 | 5/1917 | Khotinsky | 137/577 |
| 1,453,713 | 5/1923 | Kruse | 137/577 |
| 1,542,747 | 6/1925 | Verney | 494/57 |
| 2,889,160 | 6/1959 | Nelson | 74/528 |
| 3,022,937 | 2/1962 | Dega | 494/56 |
| 3,968,929 | 7/1976 | Olesen . | |
| 4,362,620 | 12/1982 | High | 494/56 |

FOREIGN PATENT DOCUMENTS

| | | |
|---|---|---|
| 2707111 | 8/1979 | Fed. Rep. of Germany . |
| 1569520 | 6/1980 | United Kingdom . |

*Primary Examiner*—Tim Miles

*Attorney, Agent, or Firm*—Edgar H. Kent; John W. Freeman

[57] ABSTRACT

A centrifuge for separation of two liquid phases of different specific gravities to be removed separately; the separation chamber has a first subset of openings communicating with a skimmer and a second subset of openings communication with a collector. In one position, a movable barrier plate covers the inner portion of the first subset and the outer portion of the second subset to direct the heavier liquid to the skimmer and the lighter liquid to the collector. Changing the barrier to a second position where the situation is reversed selectively directs the lighter liquid to the skimmer.

8 Claims, 3 Drawing Figures

CENTRIFUGE

BACKGROUND OF THE INVENTION

This invention relates to centrifuges for separation of a suspension with two liquid phases of different specific gravities to be removed separately.

A known centrifuge of this kind, in the form of a solid jacket decanter centrifuge as described in DE-PS No. 27 07 111, provides a simple apparatus for problem-free conversion between two-phase operation and three-phase operation. For two-phase operation where only one liquid phase is to be removed, all the openings to the receiving chamber which houses the skimmer mechanism are opened, while the radially-directed outlet openings are closed. A weir-barrier described below has been removed so that only the skimmer mechanism operates and draws off the liquid phase. For three-phase operation, i.e., if two liquid phases of different specific gravity must be removed separately, a portion of the openings are closed at their ends away from the separation chamber in the axial direction, and the outlet passages for these openings are opened. The weir-barrier is installed in such a way that the openings (connected as before with the receiving chamber which houses the skimmer mechanism) are connected with the separation chamber in a radially outward region, thus collecting the liquid phase of higher specific gravity while the other openings, with the aid of the weir-barrier, are connected with the separation chamber in an inner radial region, and thus collect the liquid phase of lower specific gravity, which is then conducted through associated outlet passages into a collector.

Centrifuges with skimmers, particularly those with radially adjustable skimmer heads, are among the high-quality decanter centrifuges for performing difficult separation tasks, for example, removing certain harmful products or waste products in a liquid phase. In such known centrifuges, the heavier liquid phase is conducted to the skimmer mechanism and removed by it, while the lighter liquid phase is spun off through the outlet openings. It is desirable to conduct the heavier liquid phase to the skimmer plate because the adjustability of the skimmer allows the centrifuge to be set to enable a clean separation. In such centrifuges, however, the removal of the lighter liquid phase over a weir-barrier leads to its being mixed with air. This is undesirable for some separations, specifically when the lighter liquid phase is sensitive, as is the case, for example, for volatile oils, other volatile materials, or oxidizable liquids. It therefore would be desirable to conduct the lighter liquid phase to the skimmer unit, and to be able to remove it under pressure, and thus to prevent mixing with air.

SUMMARY OF THE INVENTION

The invention is grounded on the task of providing a centrifuge of the type described at the outset, which enables in the simplest possible way withdrawal of either liquid phase selectively through the skimmer mechanism or over the weir.

The invention features a centrifuge for separation of a suspension with two liquid phases of different specific gravities to be removed separately. At one axial end the centrifuge has a cover which closes off a centrifuge separation chamber. A plurality of openings are distributed around the cover's periphery, and a first subset of those openings communicates with a collector, while a second subset of those openings communicates with a receiver equipped with a skimmer mechanism. The centrifuge comprises a barrier that partially covers the openings and is movable between a first position and a second position. In the first position, the barrier blocks the radially outward region of the first subset of openings while allowing communication between the separation chamber and the collector through the radially inward region of the first subset of openings, and the barrier blocks the radially inward region of the second subset of openings while allowing communication between the separation chamber and the receiver through the radially outward region of the second subset of openings. In the second barrier position, the barrier blocks the radially inward region of the first subset of openings while allowing communication between the separation chamber and the collector through the radially outward region of the first subset of openings, and the barrier blocks the radially outward region of the second subset of openings while allowing communication between the separation chamber and the receiver through the radially inward region of the second subset of openings.

The ability to displace the barrier enables the two subsets or groups of openings to be connected to the separation chamber selectively at the radially outward region or the radially inward region. In this way, correspondingly, it is possible to conduct the heavier or the lighter liquid phase selectively to the skimmer unit or through the outlet passages. Thus the capability is provided, depending on the suspension to be processed, to conduct to the skimmer mechanism the liquid phase which is more sensitive, particularly susceptible to mixture with air, regardless of whether it be the heavier or the lighter phase.

It is conceivable in principle for the barrier to be configured as several parts. In an especially favorable embodiment of the invention, the barrier is configured as a plate with two sets of cutouts, one set matched radially inward, and one radially outward, to the openings to the separation chamber.

It is fundamentally possible for the barrier to be configured to be movable into the different positions from outside the centrifuge. This is of particular interest for experimental and demonstration-batch purposes. In normal continuous operation for the processing of particular suspensions, however, the prominent fact is that, one and the same centrifuge type can very easily be coverted for the desired operating mode. No exchange of parts is thereby required.

It is furthermore fundamentally possible to arrange the two sets or groups of openings spatially in various configurations, such as with the openings of each set in succession around the periphery. Preferable to this, and having better rotational symmetry, is an arrangement such that the openings of one set and those of the other set are arranged alternately around the periphery of the cover piece, with a constant angular displacement from one another. The two barrier positions can be achieved by rotation from one position to the other through the angular displacement separating the openings.

Other aspects of the preferred embodiment feature: a catch that aligns and maintains the barrier in either the first or the second position by means of a reference nub (catch member) that engages one of two reference cutouts in the rim of the barrier; openings configured in the form of holes extending parallel to the drum rotation axis, the openings in the first set being closed at their ends away from the separation chamber; and a skimmer mechanism having an axial liquid outlet.

Fundamentally, the decision regarding how much of the openings is to be for collection of the lighter liquid phase, and how much for the heavier, can be made according to the respective quantities of the liquid phases. The openings will be distributed as uniformly as possible over the periphery. The cutouts of the barrier must be correspondingly arranged and must take into account radial alignment with the openings corresponding to the respective functions of the openings.

In a particularly favorable embodiment, a skimmer mechanism is used whose skimmer head is radially adjustable, particularly continuously adjustable, and/or one in which the skimmed liquid is removed axially. Such a skimmer mechanism is described in DE-Gbms No. 19 42 490. Through the continuous adjustability of the skimmer head, the separation region between the two phases of different specific gravity can be correspondingly well calibrated. Through the axial removal of the one liquid phase from the drum, it is possible to keep separate the two liquid phases which are separately withdrawn. This facilitates adjustment of the decanter from the point of view of the ultimate result of the separation. Furthermore, such a configuration of the skimmer mechanism reliably eliminates any mixing with air.

Finally, a further preferred embodiment also permits adjustment of the radial position of the outlet threshold, for example, by means of outlet tubes which are radially adjustable in connection to the radially directed outlet passages in the cover. Such radial positioning of the outlet tubes defines the threshold of the outlet tubes. This determination of the outlet threshold can be achieved for the lighter liquid phase as well as for the heavier phase, if in the case of the lighter phase the radially innermost edge of the barrier is displaced correspondingly farther outward.

The parts to be manipulated for reversing the removal of phases are relatively light in weight and easily manipulable by one operator. The cover piece itself is sufficiently thick, for manufacturing reasons, so that the openings may be made spacious enough to allow the radial outlet passages to open into them without difficulty. The cover piece and the barrier plate are extremely simple in constructional configuration and easily manufacturable. The fixing of the barrier in its different positions can be effected in various ways, it being preferable to provide a reference mark.

It is furthermore possible without difficulty to realize in addition the convertability from three-phase operations to two-phase operation in the manner of DE-PS No. 27 07 111.

DESCRIPTION OF THE PREFERRED EMBODIMENT

Figure 1:
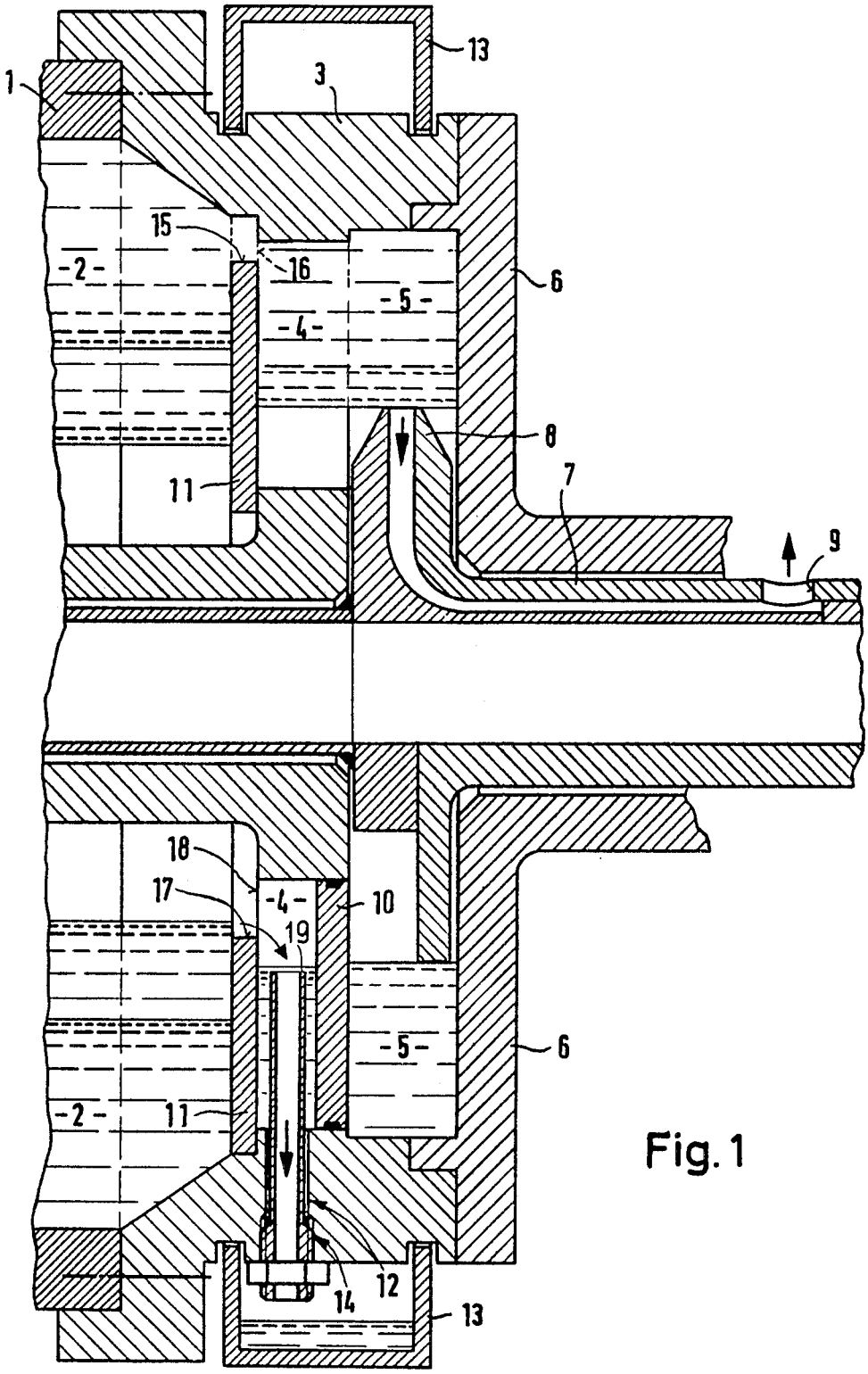
Figure 2:
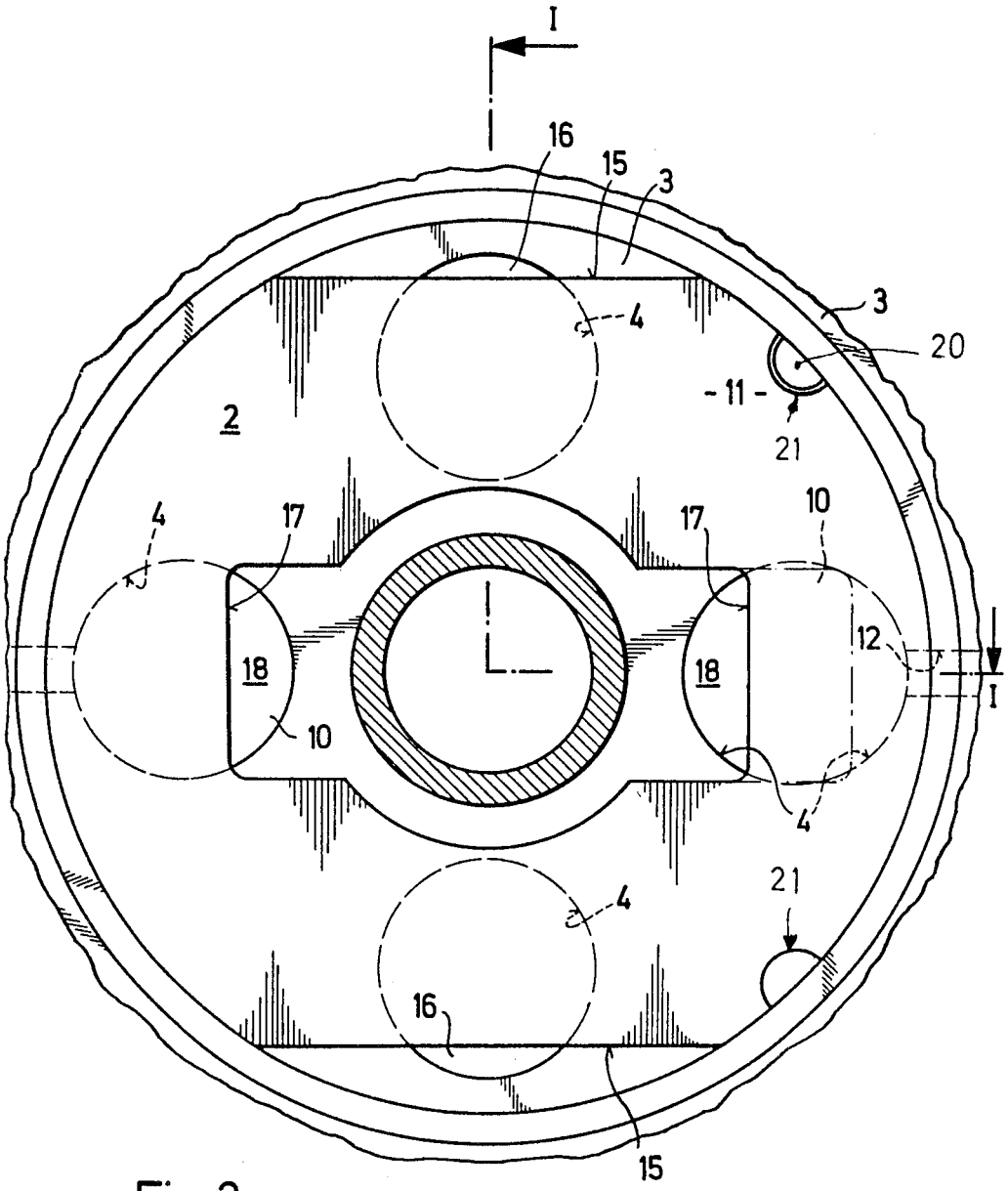
Figure 3:
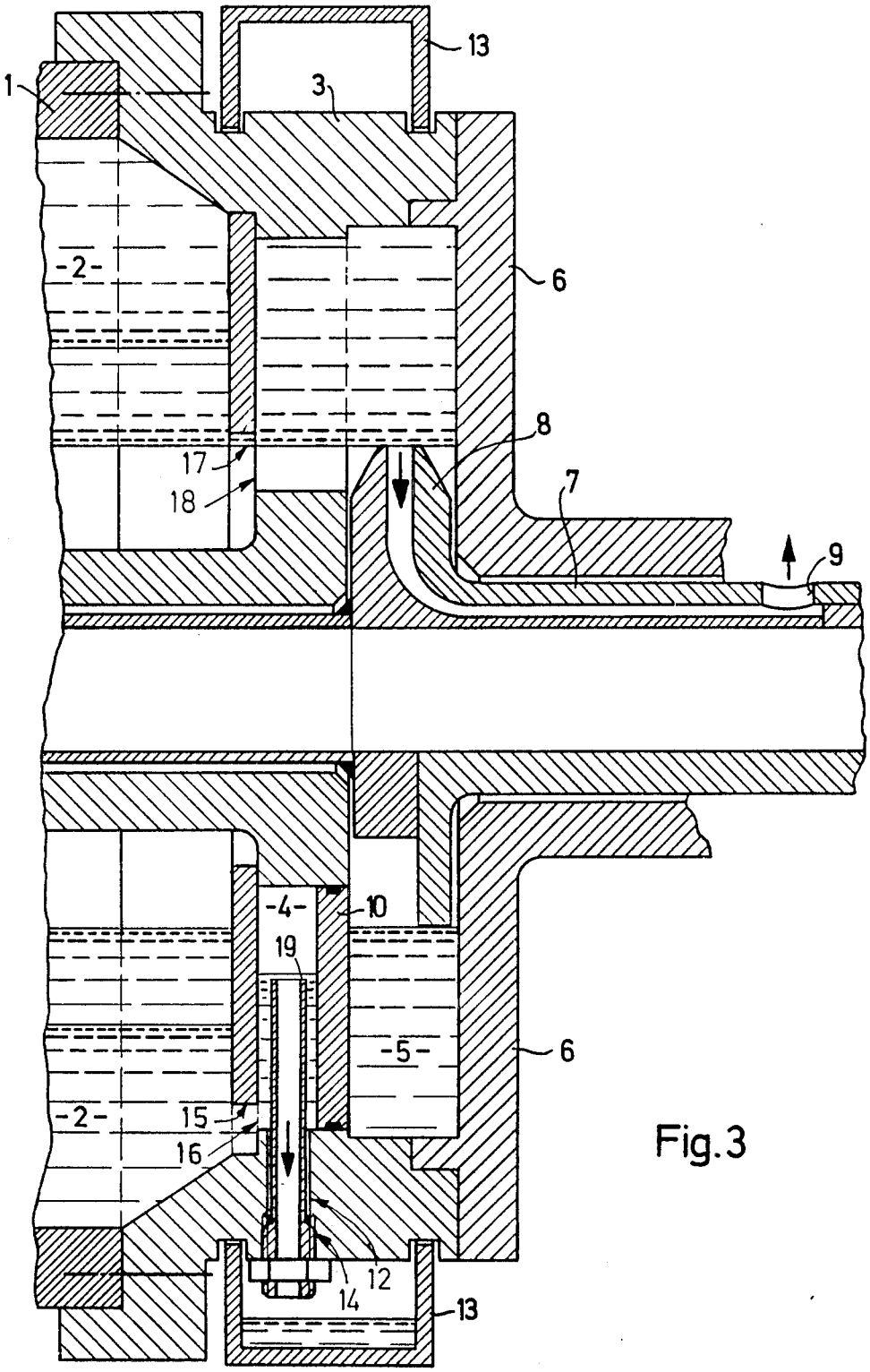

The invention is described in greater detail in conjunction with the preferred embodiment reflected in the figures, which show:

in FIG. 1, a partial cross section through the end region of the embodiment in which the skimmer mechanism is located, taken along the line I—I of FIG. 2;

in FIG. 2, a partial top view of the barrier plate in one of its displacement positions, taken from the direction of the separation chamber;

in FIG. 3, a partial cross section corresponding to FIG. 1, but with the barrier plate in its other displacement position.

The drum 1, only the extreme end of which is shown in FIG. 1, surrounds a screw conveyor, not shown, between whose hub and the inner wall of the drum is formed the separation chamber 2 of the centrifuge. The solid jacket decanter centrifuge referred to in the framework of the embodiment described here is in itself known and requires no further explanation.

Only the end of the drum opposite the solids outlet at the conically tapered end of the drum is shown. The end shown has a cover piece 3, hermetically attached to the drum 1 in a manner not described in detail. The cover piece is concentric to the drum, and its face displays four openings 4 arranged uniformly around the drum axis, each having the form of a hole axially parallel to the drum axis. The openings 4 lead from the separation chamber 2 into a receiving chamber 5, bounded on the side away from the openings 4 by a cover flange 6. Extending into the receiving chamber 5 is a skimmer mechanism 7. FIGS. 1 and 3 provide a highly diagrammatic representation of skimmer mechanism 7 and skimmer head 8; not shown is the fact that head 8 of skimmer mechanism 7 is radially adjustable from outside by rotation of a cam in a way well-known in the art. The inlet opening of the skimmer head opens into a transport channel for the received liquid, extending radially to a point near the axis, and then bending to extend in the axial direction and opening in an outlet connection 9, outside the cover flange 6, from which the channel can be drained through an attached tube.

If all the openings 4 remain open to the receiving chamber 5, the decanter is in two-phase operation, i.e., the suspension introduced into the separation chamber 2 is separated into a solid phase and liquid phase, the whole of the latter of which is withdrawn through the skimmer mechanism 7, as described in greater detail in DE-PS No. 27 07 111.

In three-phase operations—i.e., separation of a suspension into a solid phase, to be carried out by the screw conveyer, not shown, and two liquid phases of different specific gravities, indicated in FIGS. 1 and 3 by the different liquid levels in the separation chamber, with the heavier liquid phase occupying the radially outward space of the pool—the two liquid phases are to be drawn off separately. For this purpose, a first subset of the openings 4 are closed at their ends toward the separation chamber by covers 10, and thus separated from the receiving chamber 5, while the remaining subset of the openings 4 are opened at that same end, and thus communicate with the receiving chamber 5.

Moreover, all the openings 4 are covered with respect to the separating chamber in the operating mode according to FIG. 1 by means of a barrier 11, in such a way that the openings 4, which are intended to receive the lighter liquid phase, communicate with the separation chamber 2 at the radially inward section of the openings, while those openings 4 which conduct the heavier liquid phase from the separation chamber 2 into the receiving chamber 5 communicate with the separation chamber in the radially outward section of the openings. The barrier 11 provided for this purpose is matched to the spatial arrangement of the openings 4 in a most simple way, as illustrated in FIG. 2.

The openings 4 constituting the first subset, which are closed to the receiving chamber 5, communicate with outlet passages 12 directed radially outward, which open into a collector vessel 13. The liquid carried out through the first subset of openings 4 is discharged into collector vessel 13 through the outlet passages 12 and outlet tubes 19 within them. Each of the outlet tubes 19 is set in the associated outlet passage 12 by means of a screw head 14. By turning the outlet tube 19 into or out of the associated outlet passage 12, the radially inward end of the outlet tube can be adjusted in the radial direction. In this way, the outlet tubes 19 act as a radially adjustable barrier mechanism, as can be seen in greater detail in FIG. 3.

The view in FIG. 2 of the barrier 11 seen from the separation chamber 2 of the centrifuge shows the symmetrical configuration of the barrier plate 11, which indicates that the four openings 4 assume the two functions of liquid phase removal alternately around the periphery. In FIG. 1 are shown two of the openings 4 in different operating modes in a single plane, as is indicated by the broken line I—I in FIG. 2.

The barrier 11 can be conceived as manufactured from an annular plate. At two diametrically opposite positions on the perimeter, exterior segment-shaped cutouts 15 are made, which in an appropriate rotational position leave two of the four openings 4 uncovered in their radially outward regions. Through the uncovered regions 16 of these openings 4, the heavy liquid phase passes from the separation chamber 2 into the openings.

Displaced from these cutout regions 16 by 90°, and again diagonally opposite one another, in the inner rim of the annular plate are two other cutouts, 17, which in appropriate rotational position in turn leave uncovered the radially inward regions 18 of the remaining two openings 4, through which the lighter liquid phase flows out of the separation chamber 2 into the associated openings 4.

In FIGS. 1 and 2, the barrier 11 is shown in the position in which the light liquid phase passes through the cutout 17 and rim area 18 into the first subset of the openings 4, which are closed off from the receiving chamber 5 by cover 10, and open through the outlet passages 12 and outlet tubes 19 into the collecting vessel 13. The light liquid phase is thus expelled through the barrier. The heavy liquid phase leaves the separation chamber through the cutout 15 and the opening region 16 into the second subset of the openings 4, in connection with the receiving chamber 5. Thus the heavy liquid phase is conducted to the skimmer mechanism 7.

In FIG. 2, the movability of the barrier plate by 90° into its second position is indicated by a reference nub 20 and two reference cutouts 21 in the rim of the barrier, displaced from one another by an angle of 90°. The reference nub is solidly formed on the cover piece 3. If the barrier plate 11 is lifted out of the position reflected in FIG. 2, so that the first reference cutout 21 disengages from the reference nub 20, and the plate is turned 90° counterclockwise, the second reference cutout 21 will be brought into engagement with the reference nub 20. It is readily seen that in this position of the barrier, the radially inward and radially outward barrier cutouts will be reversed with respect to the openings. These relationships are reflected in FIG. 3, which is again a cross section along the line I—I of FIG. 2, but with the barrier plate rotated by 90°. In this position, the openings 4 constituting the first subset, which are closed off from the receiving chamber 5, are connected through the cutouts 15 and opening regions 16 with the radially outward region of the separation chamber 2, in which the heavy liquid phase collects. The heavy liquid phase rises in these openings 4 to the level determined by the radial adjustment of the outlet tubes 19. Through radial adjustment of the outlet tubes 19, an exact separation condition can be set, as can be done with the known radially adjustable skimmer mechanism 7. In FIG. 2, outlet tubes 19 are not shown. The dotted line referenced by 12 is passage 12. The "dash-dot" line running vertically in FIG. 2 in right-hand opening 4 indicates the flange around passage 12. In the position of barrier 11 reflected in FIG. 3, the openings 4 constituting the second subset, in communication with the receiving chamber 5, are connected through the cutouts 17 and rim regions 18 of the barrier disc with the radially inward region of the separation chamber, so that the light liquid phase collecting there can flow into these openings and thus into the receiving chamber 5.

In this case, therefore, the lighter liquid phase is drawn off by the skimmer tube, whereby an admixture of air or evaporation of components of the light liquid phase into the environment is prevented reliably.

As can be seen, all components deal with geometrically very simple, and thus easily manufacturable, forms; the parts are easily manipulable, and one worker can easily manage the conversion of the centrifuge from one operating mode to the other, according to which of the two liquid phases requires the more protective and in particular air-free handling.

The specific embodiment illustrated shows a total of four openings 4 distributed over the periphery. This is only an example. It is possible to have only two, or more than four, in particular two groups of six openings, each distributed in alternating sequence around the periphery. The barrier 11 is to be configured to match the openings; this naturally also applies to the reference marking of the angular displacement between the positions of the barrier.

I claim:

1. A centrifuge for separation of a suspension with two liquid phases of different specific gravities to be removed separately, said centrifuge being provided at one axial end with a cover which closes off a centrifuge separation chamber, said cover comprising a plurality of openings distributed around its periphery, each said opening having a radially inward region and a radially outward region, a first subset of said openings communicating with a collector through a radially extending outlet tube contained in passages in said cover, said outlet tube defining an outlet threshold that is radially adjustable, and a second subset of said openings communicating with a receiver equipped with a skimmer mechanism, said centrifuge comprising a barrier partially covering said openings, and movable between a first position and a second position, said first barrier position being characterized in that said barrier blocks said radially outward region of said first subset of openings while allowing communication between said separation chamber and said collector through said radially inward region of said first subset of openings, and being further characterized in that said barrier blocks said radially inward region of said second subset of openings while allowing communication between said separation chamber and said receiver through said radially outwrd region of said second subset of openings, and said second barrier position being characterized in that said barrier blocks said radially inward region of said first subset of openings while allowing communication between said separation chamber and said collector through said radially outward region of said first subset of openings, and being further characterized in that said barrier blocks said radially outward region of said second subset of openings while allowing communication between said separation chamber and said receiver through said radially inward region of said second subset of openings.

2. A centrifuge according to claim 1 wherein said barrier comprises a plate which bears a first set of cutouts matched with said radially inward region of said openings, and a second set of cutouts matched with said radially outward region of said openings.

3. A centrifuge according to claim 1 or claim 2 wherein said openings of said first subset of openings alternate around the circumference of said cover with said openings of said second subset openings, said openings being separated from one another by a constant angular displacement.

4. A centrifuge according to claim 3 wherein said two barrier positions are rotated apart from one another by said angular displacement between said openings.

5. A centrifuge according to claim 1 or claim 2 wherein said barrier is aligned and maintained in said first and in said second positions by a catch member.

6. A centrifuge according to claim 1 or claim 2 wherein said openings are configured in the form of holes extending axially parallel to the drum rotation axis, of which said openings of said first subset, communicating with said collector, are closed at their ends away from said separation chamber in the axial direction.

7. A centrifuge according to claim 1 or claim 2 wherein said skimmer mechanism defines an axial liquid outlet.

8. A centrifuge according to claim 1 or claim 2 wherein said outlet tube is radially adjustable by an adjustment means external to said cover, whereby said outlet threshold can be adjusted without disassembling said cover.

* * * * *